United States Patent [19]

Smith et al.

[11] Patent Number: 5,049,065

[45] Date of Patent: Sep. 17, 1991

[54] CONSTRUCTION OF CERAMIC PLAQUE BURNERS

[75] Inventors: Martin L. Smith, Birmingham; Alan Constable, Coleshill; Alan V. Hinton, Birmingham, all of England

[73] Assignee: Valor Limited, London, England

[21] Appl. No.: 452,740

[22] Filed: Dec. 21, 1989

[51] Int. Cl.[5] ..... F23D 14/12

[52] U.S. Cl. ..... 431/328; 239/568

[58] Field of Search ..... 431/328, 326, 178, 179

[56] References Cited

U.S. PATENT DOCUMENTS

| | | | |
|---|---|---|---|
| 1,919,285 | 7/1933 | Wetherbee | 431/328 |
| 1,981,602 | 11/1934 | Levey et al. | 431/347 |
| 2,788,848 | 4/1957 | Furczyk | 239/568 |
| 2,884,998 | 5/1959 | Taylor | 239/568 |
| 3,277,948 | 10/1966 | Best | 431/328 |
| 3,947,229 | 3/1976 | Richter . | |
| 4,654,000 | 3/1987 | Smith | 431/328 |

FOREIGN PATENT DOCUMENTS

| | | | |
|---|---|---|---|
| 3013434 | 10/1981 | Fed. Rep. of Germany | 431/178 |
| 2149086 | 6/1985 | United Kingdom . | |
| 2182131 | 5/1987 | United Kingdom . | |

*Primary Examiner*—Carroll B. Dority

*Attorney, Agent, or Firm*—Spencer & Frank

[57] ABSTRACT

The present specification relates to a ceramic plaque burner and to its method of construction. The plaque burner is formed as a generally planar plate with a number of parallel, narrow slit burner apertures extending therethrough. The present invention provides a ceramic plaque burner comprising a number of elongate ceramic members which are arranged parallel to each other with spacers located therebetween, a bezel engaging around the elongate ceramic members and said spacers to hold the assembly together. This construction is relatively simple and inexpensive to manufacture and avoids the problem of thermal stress cracking at the end regions of the burner slits.

15 Claims, 3 Drawing Sheets

CONSTRUCTION OF CERAMIC PLAQUE BURNERS

BACKGROUND OF THE INVENTION

The present invention relates to a ceramic plaque burner and to its method of construction.

In particular the present invention relates to a ceramic plaque burner of the type which is formed as a generally rectangular planar plate with a number of parallel, narrow slit burner apertures extending therethrough. Such a ceramic plaque burner is disclosed in our European Patent Application No. 88309459.1, which is hereby incorporated by reference, the ceramic plaque being produced as a unitary structure by moulding and heating. However, the known method of production is relatively long and expensive, the prime difficulty lying in producing the slits of uniform width along their length. A further problem with this known construction, unless particular care and attention is taken during manufacture, is that due to the effects of heat the end regions of the narrow slits tend to crack, i.e. thermal stress cracking occurs, thus reducing the life of the burner.

SUMMARY OF THE INVENTION

The aim of the present invention is to provide a ceramic plaque burner of the above type which is constructed more easily and cheaply than at present and which is not susceptible to cracking.

According to the present invention, there is provided a ceramic plaque burner, comprising a number of elongate ceramic members which are arranged parallel to each other with spacers located therebetween, to thus produce elongate burner apertures between said ceramic members.

In a preferred embodiment of the present invention the spacers are formed as a number of equi-spaced apart, like lateral projections of an elongate spacer member. A spacer member is thus located at each end region of a number of like elongate ceramic members which are arranged parallel to each other, so that the spacers spacing the elongate ceramic members apart define the required width of slit and also form the ends of each slit. The total assembly is then held together by a metal bezel which engages around the outer edge region of the assembly, the bezel also securing the plaque assembly to the top or mouth of a gas burner trough. If necessary a suitable cement may be provided between the bezel and the edge of plaque assembly. Alternatively the bezel may be made of a ceramic material or any other suitable material.

Preferably the elongate ceramic members are produced by extrusion, the extruded ceramic being cut into equal lengths. This produces an accurately dimensioned product relatively cheaply. Alternatively the elongate ceramic members may be formed by pressing. In contrast the elongate spacer members are produced by moulding with the lateral spacer projections accurately dimensioned and spaced apart. Thus, the assembled plaque has accurately formed burner slits produced with a minimum of difficulty and cost, with the problem of thermal stress cracking at the ends of the slits obviated due to the assembly type construction.

In an alternative embodiment according to the present invention, the elongate spacer members are constructed of metal, e.g. stainless steel, with laterally projecting steel spacer projections. Besides spacing the ceramic members, the metal spacer members preferably also support the end regions of the ceramic members.

In a further embodiment of the present invention, the elongate ceramic members are formed by moulding i.e. pressing, with the spacers integrally formed therewith as lateral projections at each end region thereof. Whilst the spacers can be formed on both sides at each end region, the spacers may alternatively be formed one at each end on one side or each side of each ceramic member.

According to a further aspect of the present invention, there is provided a method of manufacturing a ceramic plaque burner, comprising the steps of forming a number of equal length sections of ceramic material and arranging a number of the equal length sections parallel to each other with spacers located at each end region of the assembled parallel sections, so that each spacer is located between two adjacent parallel sections.

BRIEF DESCRIPTION OF THE DRAWINGS

The present invention will now be further described, by way of example, with reference to the accompanying drawings, in which.

DETAILED DESCRIPTION OF THE INVENTION

Figure 1:
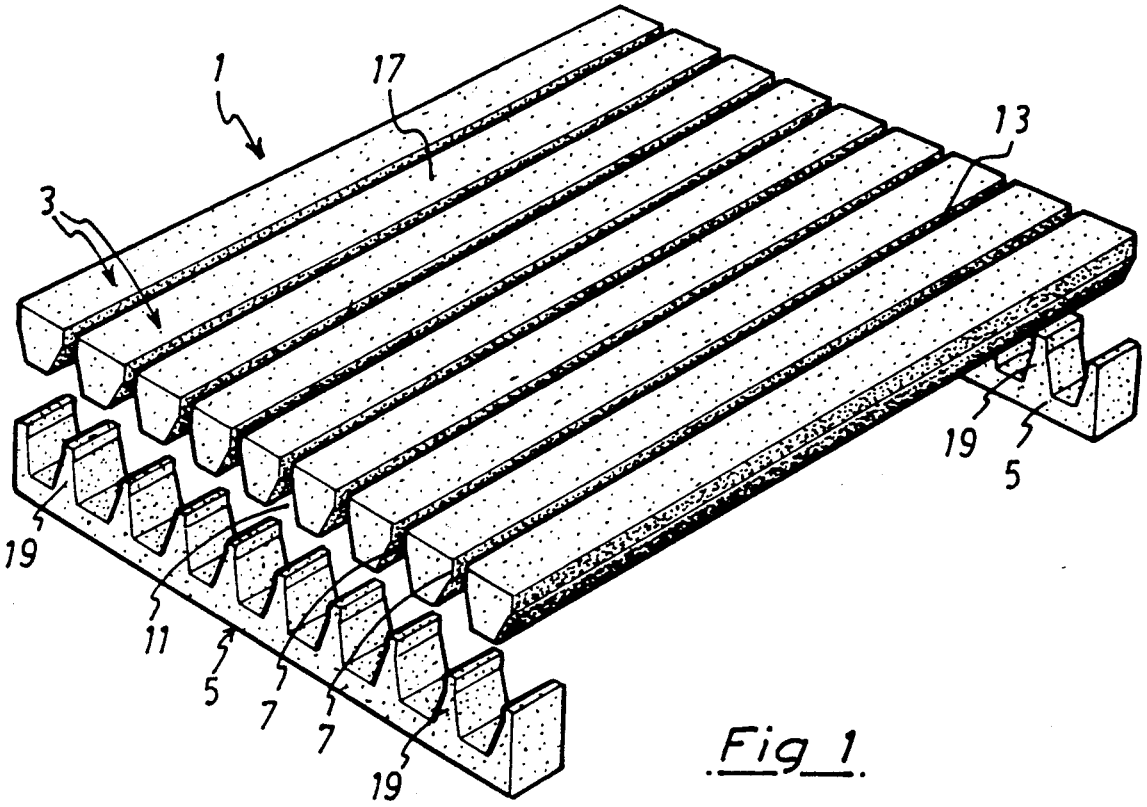
FIG. 1 is an exploded perspective view of a preferred embodiment of the present invention.
Figure 2:
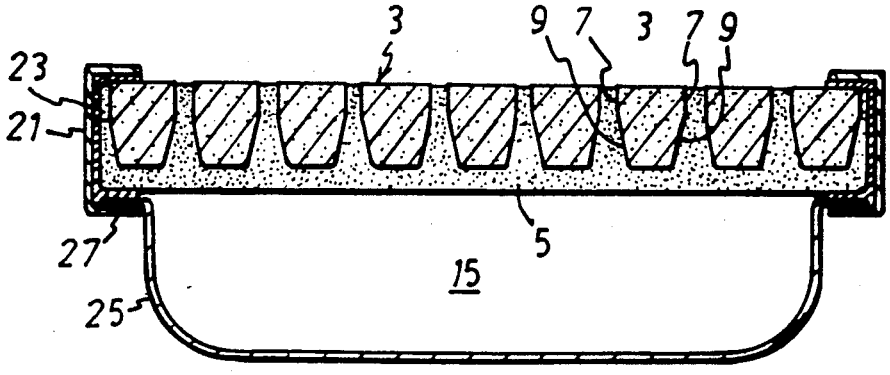
FIG. 2 is a cross-sectional end view of a gas burner incorporating the ceramic plaque burner of FIG. 1.

A preferred embodiment of a ceramic plaque burner 1 constructed according to the present invention is shown in FIGS. 1 and 2 of the accompanying drawings. The ceramic plaque burner 1 is an assembly of a number of elongated ceramic members 3 arranged parallel to each other, with an elongate spacer member 5 provided at each end region of said elongated ceramic members 3.

Preferably, each elongate ceramic member 3 is formed by extrusion and has a generally rectangular cross-section with part of two opposed faces 7 chamfered along the length of the elongate ceramic member as at 9, to thus provide a widened portion 11 of each slit 13 when the elongate ceramic members 3 are located parallel to each other. As seen in FIG. 1, this widened portion 11 guides the gas/air mix from a burner chamber 15—see FIG. 2, into the narrow slit 13, creating turbulence and enhancing mixing of the gas and air before it is burnt as it issues from the upper face 17 of the ceramic plaque. As an alternative, the elongate ceramic members 3 may be formed by pressing.

Each elongate spacer member 5 is moulded from ceramic material and has a series of equi-spaced apart, like spacer projections 19 projecting from one face thereof. Each spacer projection 19 is shaped to snugly engage the opposed faces 7 of two adjacent elongate ceramic members 3 to thus accurately position the elongate ceramic members 3 relative to each other, thereby defining both the width of a slit 13 and an end of the slit 13.

In a complete plaque, a spacer member 5 is located at each end region of a series of parallel elongate ceramic members 3, and the assembly is held together by a bezel 21 which engages around the edge of the assembly. Cement or a gasket 23 is located between the bezel 21 and the edge of the assembly and in the complete burner illustrated in FIG. 2, the metal burner shell or trough 25 is either integral with the bezel 21 or (as illustrated) engaged with its lip 27 sandwiched between the bezel 21 and plaque assembly 1. Preferably, the bezel is formed of metal although a ceramic bezel may be employed.

Figure 3:
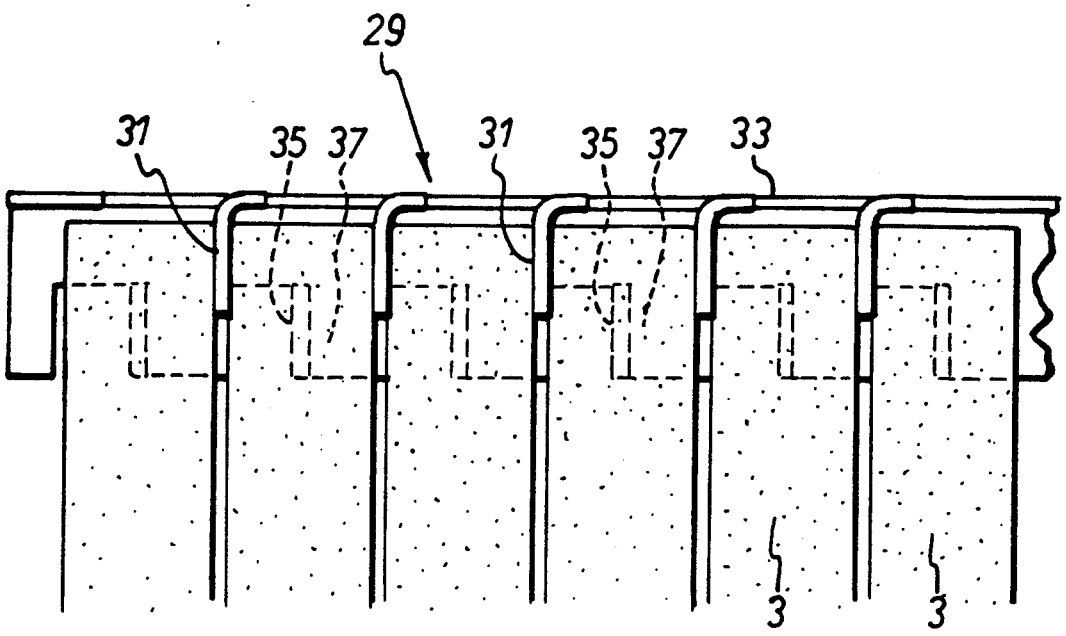
FIG. 3 is a plan view of one end region of an alternative embodiment of the present invention.
Figure 4:
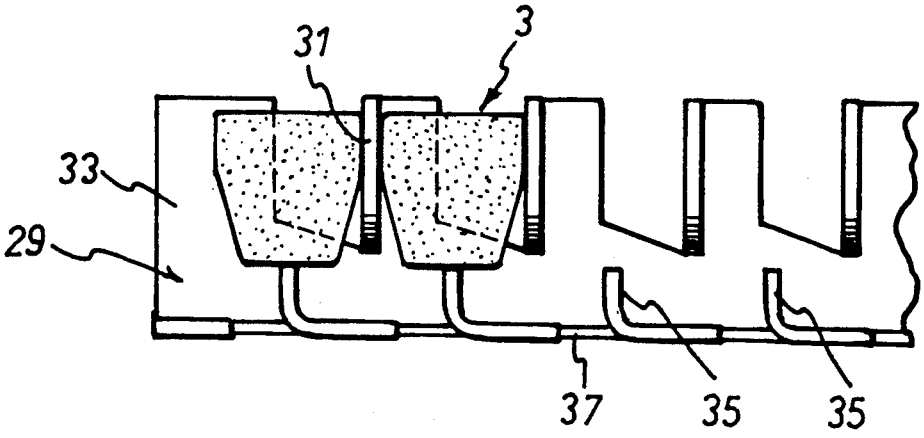
FIG. 4 is an end view of part of the embodiment of FIG. 3.

In an alternative embodiment which is illustrated in FIGS. 3 and 4, the elongate spacer members 29 are made of metal. Each elongate spacer member 29 is L-shaped in transverse cross-section with equi-spaced apart sections 31 cut and bent out of the plane of the vertical arm 33 of the L-shape, and equi-spaced apart sections 35 cut and bent out of the base arm 37. The sections 35 engage under the ceramic members 3, and the sections 31 serve as spacers between adjacent ceramic members 3.

Figure 5:
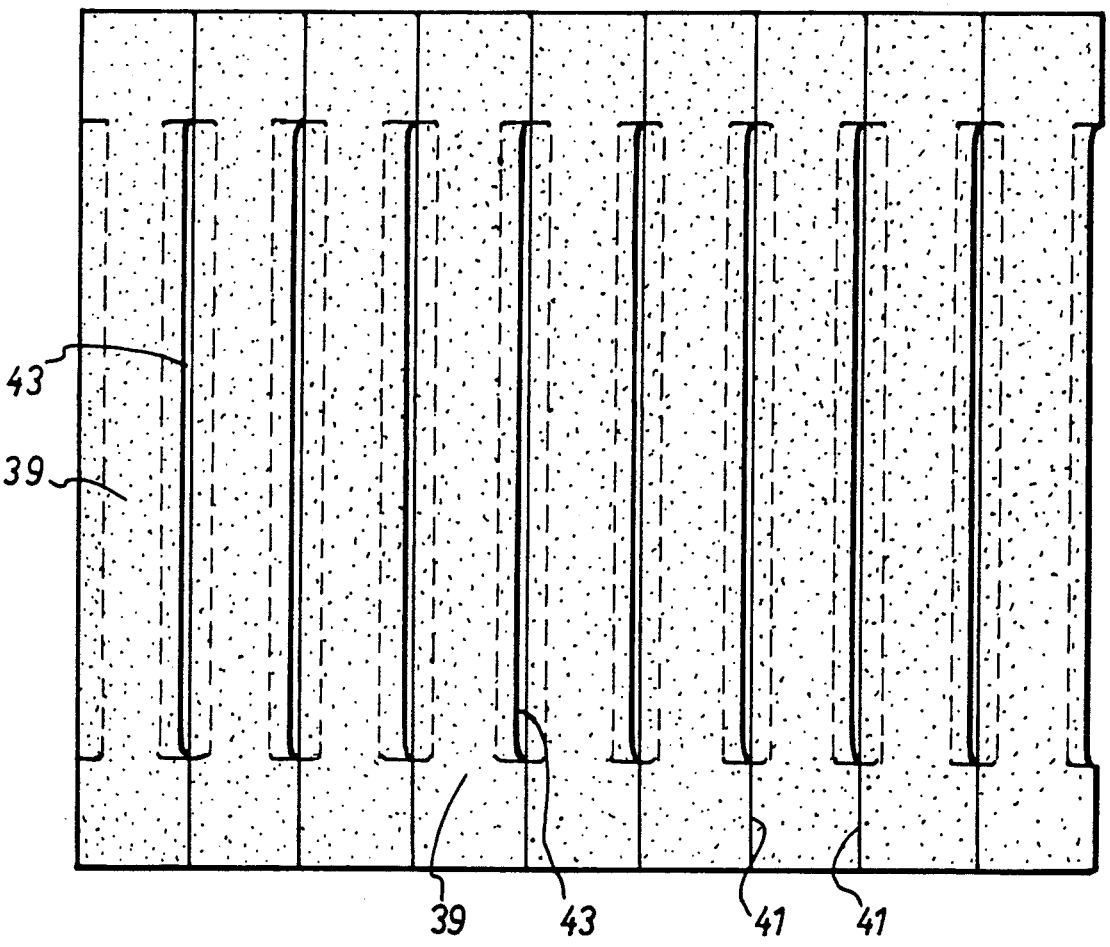
FIG. 5 is a plan view of a further embodiment of the present invention.

In a further embodiment of the present invention illustrated in FIG. 5 of the accompanying drawings, the elongate ceramic members 39 are each moulded with spacers 41 formed integrally therewith, the spacers being lateral projections 41 formed at each end region and on both sides of each ceramic member 39. The lateral projections 41 of adjacent ceramic members are thus interengaged in a complete plaque, to define the slit burner apertures 43 between adjacent ceramic members 39. In a modified form (not shown), lateral projections are formed solely on one side of each ceramic member 39 or one on one side at one end and one on the opposite side at the other end.

The present invention thus provides a simple and relatively cheap method of manufacturing a plaque burner 1 which has accurately dimensioned parallel burner slits and which overcomes the problem of thermal stress cracking which is prevalent at the ends of such slits in prior art unitary construction plaques.

We claim:

1. A ceramic plaque burner comprising a number of elongate ceramic members which are arranged parallel to each other with spacer means located therebetween to thus produce an elongate burner aperture between adjacent ceramic members, the spacer means being formed as a spacer member with at least one lateral projection, a spacer member being located at each end region of the parallel elongate ceramic members so that a lateral projection engages adjacent ceramic members to define the width and an end of a burner aperture.

2. A plaque burner according to claim 1 wherein each elongate, ceramic member has a generally rectangular transverse cross-section with part of two opposed faces chamfered along the length of the elongate ceramic member, the spacer means being of complementary configuration.

3. A plaque burner according to claim 1, wherein a bezel engages around the edge region of the assembled elongate ceramic members and spacer means.

4. A plaque burner according to claim 3, wherein cement or a gasket is located between the bezel and the edge region of the assembly.

5. A plaque burner according to claim 3, wherein a burner shell is integral with the bezel.

6. A plaque burner according to claim 3, wherein a burner shell has a lip which is sandwiched between the bezel and the assembled elongate ceramic members and spacer means.

7. A ceramic plaque burner comprising a number of elongate ceramic members which are arranged parallel to each other with spacer means located therebetween, to thus produce an elongate burner aperture between adjacent ceramic members, the spacer means being formed as a metal spacer member which has an L-shaped transverse cross-section with at least one section bent out of the plane of a first arm of the L-shaped cross-section, a spacer member being located at each end region of the parallel elongate ceramic members so that a bent section engages between adjacent ceramic members to define the width and an end of a burner aperture.

8. A plaque burner according to claim 7, wherein equi-spaced apart sections are bent out of the plane of a second arm of the L-shaped cross-section spacer member and form supports which each engage under an end region of an elongate ceramic member when said spacer members engage therebetween.

9. A plaque burner according to claim 7, wherein each elongate ceramic member has a generally rectangular transverse cross-section with part of two opposed faces chamfered along the length of the elongate ceramic member, to thus produce a tapered burner aperture between adjacent elongate ceramic members.

10. A plaque burner according to claim 7, wherein a bezel engages around the edge region of the assembled elongate ceramic members and spacer means.

11. A plaque burner according to claim 10, wherein a burner shell is integral with the bezel.

12. A plaque burner according to claim 10, wherein a burner shell has a lip which is sandwiched between the bezel and the assembled elongate ceramic members and spacer means.

13. A method of manufacturing a ceramic plaque burner comprising the steps of forming a number of equal length sections of ceramic material by extruding a continuous length of ceramic material, cutting the extruded ceramic material into the desired lengths, arranging a number of the equal length sections parallel to each other and positioning spacer means at each end region of the assembled parallel sections, each spacer means with lateral projections so that the lateral projections are located between two adjacent parallel sections, thus defining the width of burner apertures therebetween.

14. A method of manufacturing a ceramic plaque burner comprising the steps of forming a number of equal length sections of ceramic material and arranging a number of equal length sections parallel to each other with spacer means formed by molding ceramic material located at each end region of the assembled parallel sections, each spacer means having a number of equi-spaced apart, like lateral projections, each of which projections forms a spacer which is located between two adjacent parallel sections, and which lateral projections define the width of burner apertures therebetween and the end regions thereof.

15. A ceramic plaque burner comprising a number of elongate ceramic members which are arranged parallel to each other with spacer means located therebetween, to thus produce an elongate burner aperture between adjacent ceramic members, and a bezel engaging around the edge region of the assembled elongate ceramic members and spacer means, said burner having a lip which is sandwiched between the bezel and the assembled elongate ceramic members and spacer means.

* * * * *

UNITED STATES PATENT AND TRADEMARK OFFICE

CERTIFICATE OF CORRECTION

PATENT NO. : 5,049,065

DATED : September 17th, 1991

INVENTOR(S) : Martin L. SMITH et al.

It is certified that error appears in the above-identified patent and that said Letters Patent is hereby corrected as shown below:

On the title page , after the line commencing [22], please insert:

--Foreign Application Priority Data
December 23rd, 1988 [GB] United Kingdom 8830194. --.

Signed and Sealed this

Twenty-second Day of December, 1992

*Attest:*

DOUGLAS B. COMER

*Attesting Officer*

*Acting Commissioner of Patents and Trademarks*